United States Patent [19]

Green et al.

[11] Patent Number: 4,828,680

[45] Date of Patent: May 9, 1989

[54] CATALYTIC CRACKING OF HYDROCARBONS

[75] Inventors: Gary J. Green, Yardley, Pa.; Billy K. Huh, Lawrenceville, N.J.; Tsoung Y. Yan, Philadelphia, Pa.

[73] Assignee: Mobil Oil Corporation, New York, N.Y.

[21] Appl. No.: 145,952

[22] Filed: Jan. 20, 1988

[51] Int. Cl.[4] ..... C10G 11/05; C10G 25/09

[52] U.S. Cl. ..... 208/120; 208/52 CT; 208/149; 208/155; 208/251 R

[58] Field of Search ..... 208/120, 113, 52 CT, 208/251 R, 149, 155; 502/516, 521

[56] References Cited

U.S. PATENT DOCUMENTS

| | | | |
|---|---|---|---|
| 3,092,568 | 6/1963 | Atteridg | 208/251 R |
| 4,269,696 | 5/1981 | Metrailer | 208/120 |
| 4,334,976 | 6/1982 | Yan | 208/251 R |
| 4,379,747 | 4/1983 | Yan | 208/251 R |
| 4,404,091 | 9/1983 | Rankel | 208/126 |
| 4,469,588 | 9/1984 | Hettinger et al. | 208/106 |
| 4,504,377 | 3/1985 | Shu et al. | 208/251 R |
| 4,544,479 | 10/1985 | Yan | 208/126 |
| 4,650,564 | 3/1987 | Occelli et al. | 208/120 |
| 4,692,236 | 9/1987 | Sato et al. | 208/120 |

*Primary Examiner*—Anthony MacFarlane
*Attorney, Agent, or Firm*—Alexander J. McKillop; Charles J. Speciale; Malcolm D. Keen

[57] ABSTRACT

Combustible carbonaceous particles such as particles of sponge coke or coal are incorporated with the circulating inventory of cracking catalyst in a fluid catalytic cracking unit. The carbonaceous particles selectively sorb metal contaminants in the feed, thereby extending catalyst life, and they also serve to reduce $NO_x$ emissions in certain instances. The sorbed metals values may be recovered as the carbonaceous particles are burned.

7 Claims, 2 Drawing Sheets

Figure 1
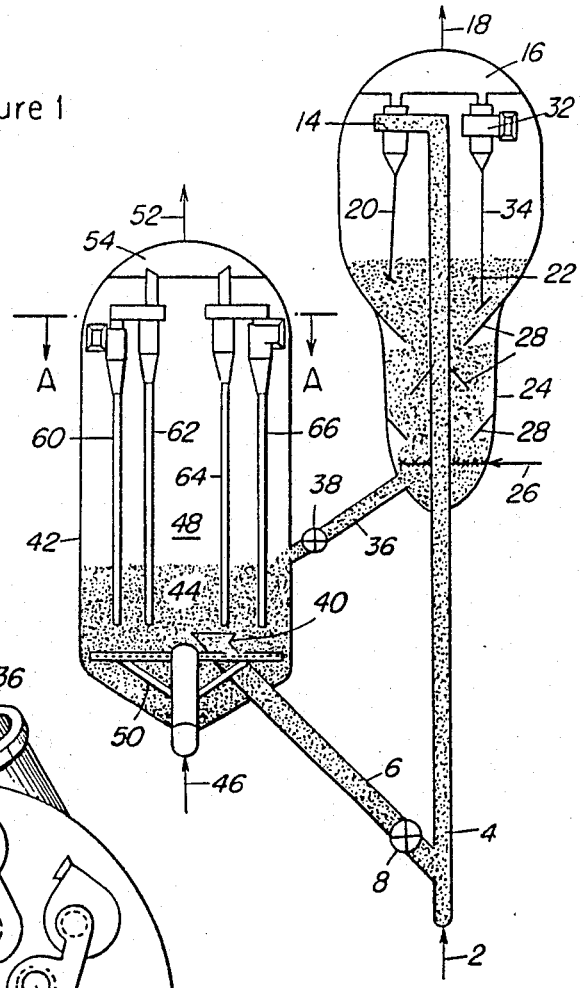
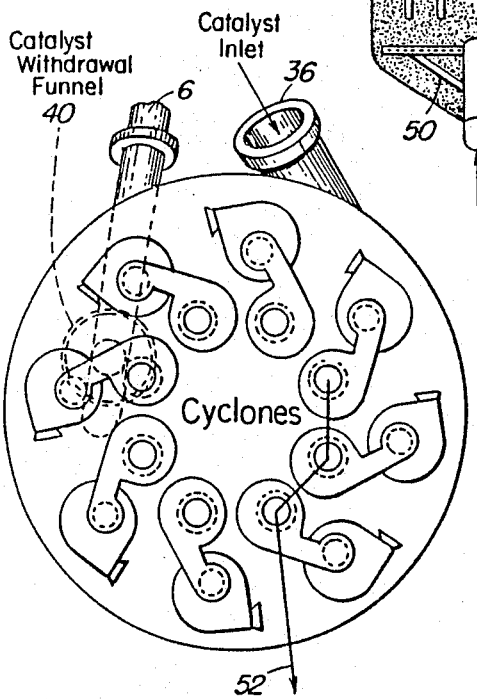
Figure 2

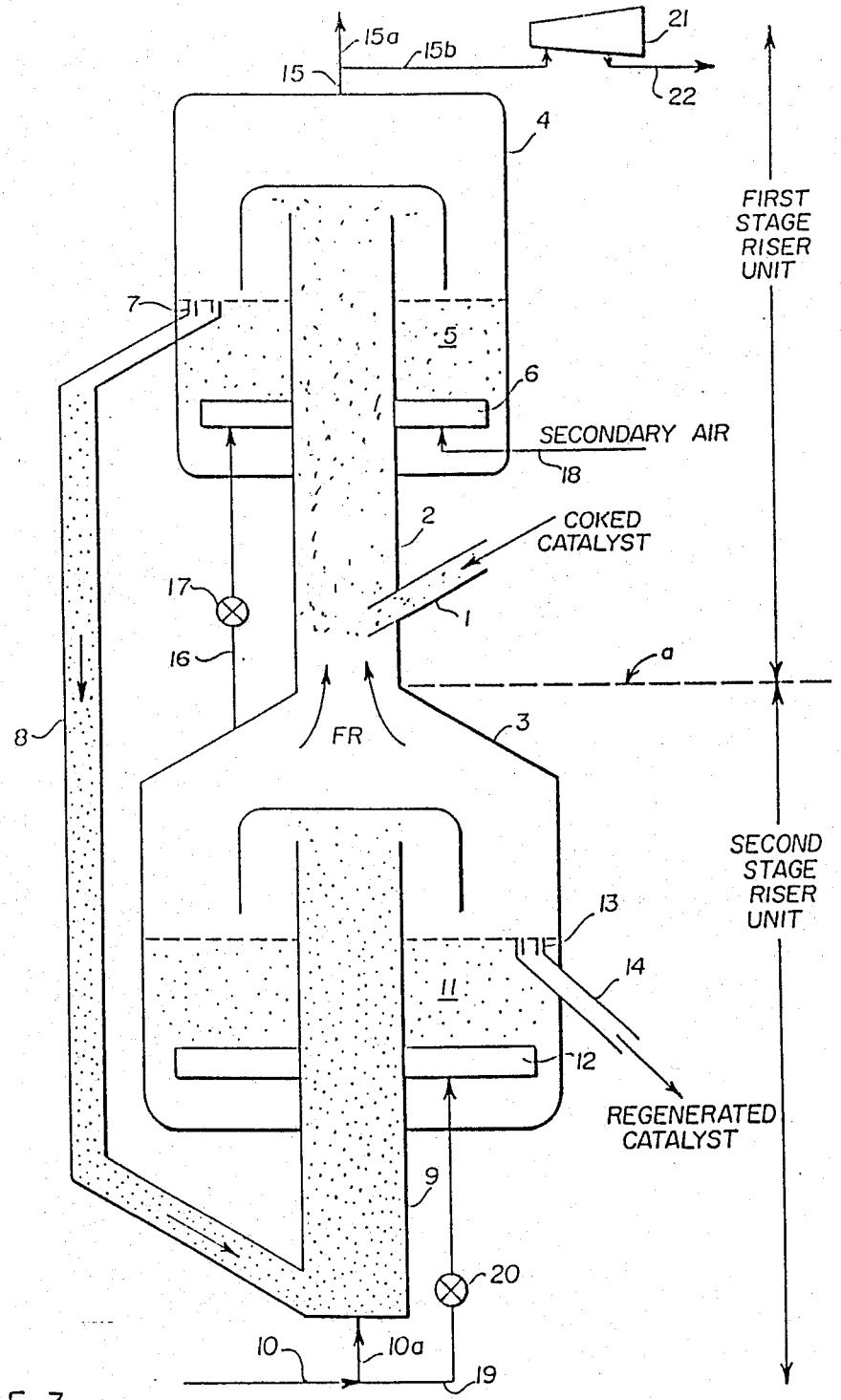
FIGURE 3 TWO-STAGE FCC REGENERATOR

CATALYTIC CRACKING OF HYDROCARBONS

BACKGROUND OF THE INVENTION

This invention is related to catalytic cracking of hydrocarbons. It more particularly refers to improvements in the endothermic catalytic cracking of petroleum fractions and alternative exothermic catalyst regeneration.

Endothermic catalytic cracking of hydrocarbons, particularly petroleum fractions, to lower molecular weight desirable products is well know. This process is practiced industrially in a cycling mode wherein hydrocarbon feedstock is contacted with hot, active, solid particulate catalyst without added hydrogen at rather low pressures of up to about 50 psig and temperatures sufficient to support the desired cracking. As the hydrocarbon feed is cracked to lower molecular weight, more valuable and desirable products, "coke" is deposited on the catalyst particles. The coked catalyst is disengaged from the hydrocarbon products, which are then separated into appropriate components. The coked catalyst particles, now cooled from the endothermic cracking and disengaged from the hydrocarbon products, are then contacted with an oxygen containing gas whereupon coke is burned off the particles to regenerate their catalytic activity. During regeneration, the catalyst particles absorb the major portion of the heat generated by the combustion of coke, i.e. they are "reflexively" heated, with consequent increase of catalyst temperature. The heated, regenerated catalyst particles are then contacted with additional hydrocarbon feed and the cycle repeats itself.

A flue gas comprising carbon oxides and, to a lesser extent, nitrogen oxides is produced during regeneration. The carbon monoxide and nitrogen oxides are sometimes vented to the atmosphere with the rest of the flue gas. Alternatively, the carbon monoxide in some plants is burned to carbon dioxide, in a CO boiler to recover process steam and reduce emissions.

Two major variants for endothermically cracking hydrocarbons are fluid catalytic cracking (FCC) and moving bed catalytic cracking. In both of these processes as commercially practiced, the feed hydrocarbon and the catalyst are passed through a "reactor"; are disengaged; the catalyst is regenerated with cocurrent and/or countercurrent air; and the regenerated reflexively heated catalyst recontacted with more feed to start the cycle again. These two processes differ substantially in the size of the catalyst particles utilized in each and also in the engineering of materials contact and transfer which is at least partially a function of the catalyst size.

In fluid catalytic cracking (FCC), the catalyst is a fine powder of about 10 to 200 microns, preferably about 70 micron, size. This fine powder is generally propelled upwardly through a riser reaction zone suspended in and thoroughly mixed with hydrocarbon feed. The coked catalyst particles are separated from the cracked hydrocarbon products, and after purging are transferred into the regenerator where coke is burned to reactivate the catalyst. Regenerated catalyst generally flows downward from the regenerator to the base of the riser.

One typical example of industrially practiced moving bed hydrocarbon catalytic cracking is known as Thermofor Catalytic Cracking (TCC). In this process the catalyst is in the shape of beads or pellets having an average particle size of about 1/64 to ¼ inch, preferably about ⅛ inch. Active, hot catalyst beads progress downwardly cocurrent with a hydrocarbon charge stock through a cracking reaction zone. In this zone hydrocarbon feed is endothermically cracked to lower molecular weight hydrocarbons while coke is deposited on the catalyst. At the lower end of the reaction zone the hydrocarbon products are separated from the coked catalyst, and recovered. The coked catalyst is then passed downwardly to a regeneration zone, into which air is fed such that part of the air passes upwardly countercurrent to the coked catalyst and part of the air passes downwardly cocurrent with partially regenerated catalyst. Two flue gases comprising carbon oxides are produced. Regenerated catalyst is disengaged from the flue gas and is then lifted, pneumatically or mechanically, back up to the top of the reaction zone.

The catalysts used in endothermic catalytic nonhydrogenative cracking are to be distinguished from catalysts used in exothermic catalytic hydrocracking. Operating conditions are also to be distinguished. While the catalytic cracking processes to which this invention is directed operate at low pressures near atmospheric and in the absence of added hydrogen, hydrocracking is operated with added hydrogen at high pressures of up to about 1000 to 3000 psig. Further, nonhydrogenative catalytic cracking is a reflexive process with catalyst cycling between cracking and regeneration (coke burn off) over a very short period of time, seconds or minutes. In hydrocracking, on the other hand, the catalyst remains in cracking service for an extended period of time, months, between regeneration (coke burn off). Another important difference is in the product. Nonhydrogenative catalytic cracking produces a highly unsaturated product with substantial quantities of olefins and aromatics, and a high octane gasoline fraction. Hydrocracking, in contrast, produces an essentially olefin-free product with a relatively low octane gasoline. This invention is not directed to hydrocracking nor is it within the scope of this invention to use hydrocracking catalysts in the process hereof.

FIG. 1 and the sectional element thereof shown in FIG. 2 are representative of a commercial fluid catalytic cracking unit. Referring now to FIG. 1, a hydrocarbon feed 2 such as a gas oil boiling from about 600 degrees F. up to 1000 degrees F. is passed after preheating thereof to the bottom portion of riser 4 for admixture with hot regenerated catalyst introduced by standpipe 6 provided with flow control valve 8. A suspension of catalyst in hydrocarbon vapors at a temperature of at least about 950 degrees F. but more usually at least 1000 degrees F. is thus formed in the lower portion of riser 4 for flow upwardly therethrough under hydrocarbon conversion conditions. The suspension initially formed in the riser may be retained during flow through the riser for a hydrocarbon residence time in the range of 1 to 10 seconds.

The hydrocarbon vapor-catalyst suspension formed in the riser reactor is passed upwardly through riser 4 under hydrocarbon conversion conditions of at least 900 degrees F. and more usually at least 1000 degrees F. before discharge into one or more cyclonic separation zones about the riser discharge, represented by cyclone separator 14. There may be a plurality of such cyclone separator combinations comprising first and second cyclonic separation means attached to or spaced apart from the riser discharge for separating catalyst particles from hydrocarbon vapors. Separated hydrocarbon vapors are passed from separator 14 to a plenum chamber 16 for withdrawal therefrom by conduit 18. These hydrocarbon vapors together with gasiform material separated by stripping gas as defined below are passed by conduit 18 to fractionation equipment not shown. Catalyst separated from hydrocarbon vapors in the cyclonic separation means is passed by diplegs represented by dipleg 20 to a dense fluid bed of separated catalyst 22 retained about an upper portion of riser conversion zone 4. Catalyst bed 22 is maintained as downwardly moving fluid bed of catalyst countercurrent to rising gasiform material. The catalyst passes downwardly through a stripping zone 24 immediately therebelow and countercurrent to rising stripping gas introduced to a lower portion thereof by conduit 26. Baffles 28 are provided in the stripping zone to improve the stripping operation.

The catalyst is maintained in stripping zone 24 for a period of time sufficient to effect a higher temperature desorption of feed deposited compounds which are then carried overhead by the stripping gas. The stripping gas with desorbed hydrocarbons pass through one or more cyclonic separating means 32 wherein entrained catalyst fines are separated and returned to the catalyst bed 22 by dipleg 34. The hydrocarbon conversion zone comprising riser 4 may terminate in an upper enlarged portion of the catalyst collecting vessel with the commonly known bird cage discharge device or an open end "T" connection may be fastened to the riser discharge which is not directly connected to the cyclonic catalyst separation means. The cyclonic separation means may be spaced apart from the riser discharge so that an initial catalyst separation is effected by a charge in velocity and direction of the discharged suspension so that vapors less encumbered with catalyst fines may then pass through one or more cyclonic separation means before passing to a product separation step. In any of these arrangements, gasiform materials comprising stripping gas hydrocarbon vapors and desorbed sulfur compounds are passed from the cyclonic separation means represented by separator 32 to a plenum chamber 16 for removal with hydrocarbon products of the cracking operation by conduit 18. Gasiform material comprising hydrocarbon vapors is passed by conduit 18 to a product fractionation step not shown. Hot stripped catalyst at an elevated temperature is withdrawn from a lower portion of the stripping zone by conduit 36 for transfer to a fluid bed of catalyst being regenerated in a catalyst regeneration zone. Flow control valve 38 is provided in transfer conduit 36.

This type of catalyst regeneration operation is referred to as a swirl type of catalyst regeneration due to the fact that the catalyst bed tends to rotate or circumferentially circulate about the vessel's vertical axis and this motion is promoted by the tangential spent catalyst inlet to the circulating catalyst bed. Thus, the tangentially introduced catalyst at an elevated temperature is further mixed with hot regenerated catalyst or catalyst undergoing regeneration at an elevated temperature and is caused to move in a circular or swirl pattern about the regenerator's vertical axis as it also moves generally downward to a catalyst withdrawal funnel 40 (sometimes called the "bathtub") adjacent the regeneration gas distributor grid. In this catalyst regeneration environment, it has been found that the regeneration gases comprising flue gas products of carbonaceous material combustion tend to move generally vertically upwardly through the generally horizontally moving circulating catalyst to cyclone separators positioned above the bed of catalyst in any given vertical segment. As shown by FIG. 2, the catalyst tangentially introduced to the regenerator by conduit 36 causes the catalyst to circulate in a clockwise direction in this specific embodiment. As the bed of catalyst continues its circular motion some catalyst particles move from an upper portion of the mass of catalyst particles suspended in regeneration gas downwardly therethrough to a catalyst withdrawal funnel 40 in a segment of the vessel adjacent to the catalyst inlet segment. In the regeneration zone 42 housing a mass of the circulating suspended catalyst particles 44 in upflowing oxygen containing regeneration gas introduced to the lower portion thereof by conduit distributor means 46, the density of the mass of suspended catalyst particles may be varied by the volume of regeneration gas used in any given segment or segments of the distributor grid. Generally speaking, the circulating suspended mass of catalyst particles 44 undergoing regeneration with oxygen containing gas to remove carbonaceous deposits by burning will be retained as a suspended mass of swirling catalyst particles varying in density in the direction of catalyst flow and a much less dense phase of suspended catalyst particles 48 will exist thereabove to an upper portion of the regeneration zone. Under carefully selected relatively low regeneration gas velocity conditions, a rather distinct line of demarcation may be made to exit between a dense fluid bed of suspended catalyst particles and a more dispersed suspended phase (dilute phase) of catalyst therabove. However, as the regeneration gas velocity conditions are increased there is less of a demarcation line and the suspended catalyst passes through regions of catalyst particle density generally less than about 30 lbs. per cu. ft. A lower catalyst bed density of at least 20 lb/cu. ft. is preferred.

A segmented regeneration gas distributor grid 50 positioned in the lower cross-sectional area of the regeneration vessel 42 is provided as shown in FIG. 1 and is adapted to control the flow of regeneration gas passed to any given vertical segment of the catalyst bed thereabove. In this arrangement, it has been found that even with the generally horizontally circulating mass of catalyst, the flow of regeneration gas is generally vertically upwardly through the mass of catalyst particles so that regeneration gas introduced to the catalyst bed by any given grid segment or portion thereof may be controlled by grid openings made available and the air flow rate thereto. Thus, oxygen containing combustion gases after contact with catalyst in the regeneration zone are separated from entrained catalyst particles by the cyclonic means provided and vertically spaced thereabove. The cyclone combinations diagrammatically represented in FIG. 1 are intended to correspond to that represented in FIG. 2. Catalyst particles separated from the flue gases passing through the cyclones are returned to the mass of catalyst therebelow by the plurality of provided catalyst diplegs.

As mentioned above, regenerated catalyst withdrawn by funnel 40 is conveyed by standpipe 6 to the hydrocarbon conversion riser 4.

The regenerator system shown in FIGS. 1 and 2 is of a type originally designed for producing a flue gas the contains a substantial concentration of carbon monoxide along with carbon dioxide. In fact, a typical $CO^2/CO$ ratio is about 1.2 (i.e., in the absence of a CO-oxidation promoter).

Other regenerator designs for FCC units have been proposed. A number of these utilize more than one regeneration zone. For example, the design shown in FIG. 3 of the drawing and its use in mitigating air polution are described in commonly assigned U.S. patent application Ser. No. 056,082, filed May 29, 1987, the entire contents of which are incorporated herein by reference as if fully set forth.

The last two decades have seen two major developments in catalyst compositions for use in catalytic cracking. The catalysts formerly widely employed in FCC and TCC have included acid treated clays, amorphous silica-alumina composites and the like. Many variants, such as silica-zirconia, silica-magnesia and other acidic porous solids have been described in the literature.

The first of the major developments provides much more effective catalysts by blending a major portion of the older amorphous catalysts with a minor portion of an active crystalline aluminosilicate zeolite. Catalysts of this type for FCC and TCC are described in U.S. Pat. Nos. 3,140,249 and 3,140,253, the disclosures of which are hereby incorporated by reference. The active crystalline aluminosilicate component of such catalysts, usually a large pore zeolite of the faujasite crystal type, imparts high activity with very good selectivity to the cracking catalyst. Such catalysts have become very widely used in fluid catalytic cracking, supplanting the older amorphous synthetic silica-alumina catalysts almost completely. The term "zeolite cracking catalyst" as used herein means a catalyst essentially of the type described in U.S. Pat. Nos. 3,140,249 and 3,140,253, and variants thereof, such as those which also include a ZSM-5 type zeolite.

In FCC and TCC a problem arises from incomplete combustion, leaving a significant amount of carbon monoxide (CO) in the flue gas. Aside from the undesirability of discharge of CO to the atmosphere, such flue gases tend to sporadically burn (by reaction of CO with residual oxygen in the flue gas) in ducts and flues of the plant (afterburning), damaging these structures by excessive temperatures. A second major development came from the discovery that trace amounts of a platinum group metal, such as 1.0 parts per million of platinum incorporated with the cracking catalyst, effectively catalyzes the complete burning of carbon monoxide to carbon dioxide in the regenerator without detriment to the cracking reaction. This development simultaneously eliminated the environmental problem and the problem of sporadic afterburning, and has been very widely accepted by refiners. Such catalysts and their use are described in U.S. Pat. Nos. 4,251,395; 4,265,787; 4,088,568; 4,072,600; 4,093,535 and 4,159,239; all to Schwartz, are incorporated herein by reference for further details on composition and use. As described therein, such promoted catalysts may be used to completely burn CO (referred to hereinbelow as "full CO-combustion") or to only partially burn the CO (referred to hereinbelow as "partial CO-combusion") by the simple expedient of limiting the oxygen supplied to the regenerator. The term "Pt group metal CO-oxidation promoter" as used herein means those metals and their mode of use as taught by the Schwartz patents cited above.

Regardless of the aforementioned advances, cracking catalysts are still adversely affected by metals such as nickel and vanadium contained in the feed. The problem is aggravated by the trend towards processing heavier feeds and towards including some residual oil along with gas oil, both of which increase the rate of metals accumulation on the catalyst and detract from gasoline and alkylate selectivity. Nickel deposits on the catalyst have deleterious effects on conversion and $C_5+$ gasoline selectivity primarily by increasing coke made and hydrogen production due to nickel's inherent dehydrogenation activity. In addition to its effect on selectivity, recent studies have shown that vanadium deposits on cracking catalyst lead to premature loss of crystallinity, probably due to the formation of vanadic acid during regeneration. (See, for example, Speronello et al., Oil and Gas Journal, Jan. 30, 1984, page 139; and Ritter et al., Oil and Gas Journal, July 6, 1981, page 103.

A further problem encountered by the refiner arises from increased environmental constraints on emission of nitrogen oxides ($NO_x$) contained in the flue gas. Operation with CO-combustion promoters, which solves the CO emissions problem, can in some instances increase the $NO_x$ emissions.

It is an object of this invention to provide a novel means for extending the useful life of a zerolite cracking catalyst.

It is another object of the present invention to decrease the rate of metal accumulation on the FCC catalyst while increasing the flexibility of the heat balance around the FCC process.

It is a further objective to provide a means for reducing $NO_x$ emissions when operating in the full CO-burning mode.

Other objects of this invention will become apparent from a consideration of this entire specification including the appended claims.

BRIEF DESCRIPTION OF THE DRAWING

FIG. 1 exemplifies a fluid catalytic cracking apparatus.

FIG. 2 illustrates a swirl regenerator.

FIG. 3 illustrates a 2-stage riser regenerator.

DETAILED DESCRIPTION OF THE INVENTION

In accord with and fulfilling these objects, one aspect of this inventive concept requires addition to the circulating inventory of zerolite cracking catalysts separate particles of a solid carbonaceous material, the addition being effective to provide a steady state concentration of about 0.1 to about 10.0 weight percent of said particles in the cracking zone, with a preferred concentration of about 0.5 to 7.0 weight percent. In the cracking zone, a portion of the metals carried in with the fresh feed is deposited on the separate particles of the carbonaceous material, serving to reduce the amount of said metals available for deposition on the catalyst. When the catalyst and carbonaceous particles pass through the regeneration zone, the coke on the catalyst is burned off together with a fraction of the carbonaceous particles. Due to their relatively refractory nature and their exceedingly larger mass fraction of carbon per particle, the extent of burnoff of the carbonaceous particles is significantly less than that of the coke on the catalyst particles and is limited primarily to the oxidation of the outer surface layers. Since the metals, such as nickel and vanadium, which are deposited on the carbonaceous particles tend to be concentrated in these outer layers, they are removed from the carbonaceous particles as metal oxides during the burnoff, exiting the regenerator with the flue gas in the form of a fine dust which is recovered by an electrostatic precipitator or other means downstream of the regenerator. With repeated cycling of the catalyst and carbonaceous particles, the carbonaceous particles originally introduced are consumed, necessitating the continuous addition of carbonaceous particles at a makeup rate sufficient to maintain the required metals-scavenging activity. This makeup rate is determined by the nature of the carbonaceous particles and the extent of their burnoff in the regenerator, but will be in a range so as to keep the steady state concentration between 0.1 and 10 weight percent, and preferably between 0.5 and 7.0 weight percent. The net result of the process of this invention is that a portion of the metals introduced by the feed to the cracker is withdrawn from the system, thereby reducing the rate of accumulation of metals on the catalyst. The effect of this reduced rate of accumulation is to extend catalyst life, improve catalyst selectivity for gasoline and fuel oil, and substantially reduce the requirement for makeup catalyst. Alternatively, the refiner may choose to use a heavier gas oil cut that is more heavily contaminated with metals, or other such alternative, to realize economic advantage.

In a second embodiment of this invention, the separate particles of carbonaceous material is added to a circulating inventory of zeolitic cracking catalyst that contains a platinum metal CO-oxidation promoter. This embodiment permits control of the emissions of carbon monoxide from the regenerator, regardless of whether the carbon monoxide arises from the burning and regeneration of coke on catalyst, or whether it arises from the partial burning of the separate carbon particles.

In a third embodiment, the concept is to use the present invention in conjunction with a riser regenerator that provides at least two regeneration zones, the first of which operates in an oxygen-deficient environment. Such as configuration permits operation in the complete CO-combustion mode, with diminished emissions of nitrogen oxide facilitated by the presence of the carbon particles, all as more fully described hereinunder.

The feed to the process of this invention may be any conventional petroleum fraction suitable for cracking to gasoline and fuel oil, and it may include, as a portion or all of the feed, fractions that are more heavily contaminated with metals than those in common usage. The cracking catalyst useful in the process of this invention may be any commonly used zeolitic cracking catalyst. A feature of this invention is that catalysts which are so selective for gasoline and fuel oil that torch oil or the like is normally required to provide heat balance may be advantageously used in the present invention since combustion of the carbonaceous particles obviates the need for external fuel.

The term "carbonaceous material" as used herein means a combustible solid composed largely of carbon which may be associated with some hydrogen.

Such carbonaceous materials are chosen from petroleum cokes, which are derived from liquid phase thermal pyrolysis of petroleum residues and heavy oils in commercial processes such as delayed coking, fluid coking, or flexicoking; coals, including bituminous, sub-bituminous, and lignite; coal chars and cokes; biomass derived materials, including wood pyrolysis residues and charcoal; carbon blacks; and graphites. To be used in the current process, such materials should be in the form of particles sized to 200 microns or less; the size of the particles is chosen to be commensurate with that of the FCC catalyst particles. For delayed cokes, coals, and biomass materials, for example, such particles are prepared by grinding and/or pulverizing, followed by screening or sizing using elutriation or other methods. The bulk density of the carbonaceous particles is typically in the range of 0.6 to 1.1 g/cc for most cokes and coals and ranges up to about 1.8 g/cc for some graphites. Surface areas of these particles are typically in the range of about 1 to 100 $m^2/g$.

As will be shown hereinbelow, carbonaceous solids vary in their selectivity vis-a-vis cracking catalyst for the selective sorption of vanadium, ranging from about equivalent to about 20 fold greater, or more, when measured as described in Example 1, below. The selectivity for vanadium sorption is defined by a partition coefficient, $K_v$, as follows:

$$K_v = \frac{\text{Concentration of Vanadium on Carbonaceous Solid}}{\text{Concentration of Vanadium on Cracking Catalyst}} \quad \text{(Eq. 1)}$$

Preferential scavenging of vanadium by an added carbonaceous solids occurs when $K_v$ 1. It is also contemplated that scavenging of other metals such as nickel, for example, is also accomplished by the added carbonaceous solid as described by the method of this invention.

In general, it is preferred to use carbonaceous material that has a partition coefficient $K_v$ of at least about 1.5, and particularly preferred to use material with a $K_v$ of at least about 10. Sponge coke, which is a type of delayed coke, is a preferred carbonaceous solid, since it is a readily available and low valued refinery by-product having a $K_v$ greater than 10.

The separate particles of solid carbonaceous material is introduced into the circulating inventory at any convenient point, such as by adding the particles into the regenerator along with the fresh makeup cracking catalyst. This may be accomplished, for example, in an analogous fashion to the manner in which CO combustion promoter additives or ZSM-5 octane enhancing additives are introduced into the fresh makeup cracking catalyst, where separate additive hoppers and feed mechanisms are used to dispense the requisite amounts of additive into the flow of fresh makeup cracking catalyst before it enters the regenerator. Alternatively, the carbonaceous particles may be introduced into the system downstream of the primary combustion zone of the regenerator, for example, by adding them to the regenerated catalyst as it proceeds from the regenerator to the reactor. Finally, the carbonaceous particles may be introduced into the system on the reactor side by adding them directly to the FCC hydrocarbon feedstock. In this case, the particles are mixed and dispersed in the feed prior to the point where the feed is sprayed into the base of the reactor to mix with the incoming regenerated cracking catalyst. The carbonaceous particles are introduced into the system continuously or at convenient intervals. If introduced at intervals, the intervals should be sufficiently close as to avoid destabilizing the cracking and regeneration operation due to drastic changes of carbon content in the circulating inventory. The amount of carbonaceous material introduced is that sufficient to provide a steady state concentration of about 0.1 to about 10.0 wt % based on cracking catalyst in the cracking zone, with a preferred range of 0.5 to about 5.0 weight percent.

The following examples are provided to illustrate the scavenging selectivity for vanadium that carbonaceous particles have when used under FCC process conditions as well as the $NO_x$ reducing effect of carbonaceous materials when used under simulated FCC regeneration conditions. The examples are not to be construed as limiting the scope of this invention, which scope is determined by this entire specification and the appended claims.

EXAMPLE 1

This example illustrates the partitioning at cracking temperature of vanadium contained in a gas oil feed between a commercial cracking catalyst and particles of carbonaceous material when the two are mixed together.

The feed consisted of an Arab Light gas oil that was doped with vanadyl-naphtenate (ICN pharamaceuticals). The vanadium concentration in the oil was 0.43 wt %. Reactions were carried out in a dense fluidized bed at 500° C., 1 LHSV, 5900 SCF/B helium with loadings of 5 grams each of FCC catalyst and carbonaceous solid. In order to facilitate the separation of catalyst and carbonaceous solid following the run, different particle size ranges were used for each pair of materials. Nominal particle size (diameter) ranges of 180 to 425 microns, and 85 to 100 microns, were utilized in this study for the carbonaceous solids and FCC catalyst, respectively, and the particles remained essentially intact during the run. The duration of each run was 10 min. During each 10 min. pumping interval, 0.01 grams of vanadium was charged to the reactor. In our experiments we observed very little vanadium (10 ppm) in any of the liquid products indicating that vanadium was removed very efficiently in the dense fluid bed.

Table I shows that both shot and sponge cokes, both being delayed coked, preferentially sorbed vanadium, as indicated by $K_v$'s greater than one. However, sponge coke was found to be particularly effective, having a $K_v=17.5$.

TABLE I

| Catalyst/ C-Particles | Vanadium Partitioning Mesh Size | BET Surface Area ($m^2/g$) | % Relative Vanadium | $K_v$ |
|---|---|---|---|---|
| FCC Catalyst | 140/170 | 117 | 42.4 | 1.4 |
| Shot Coke | 40/80 | 5 | 57.6 | |
| FCC Catalyst | 140/170 | 117 | 5.4 | 17.5 |
| Sponge Coke | 60/80 | 5 | 94.6 | |

*Based on 0.01 grams of vanadium deposited in 10 minute period. If equally distributed, both catalyst and carbon would contain 1000 ppm.

EXAMPLE 2

This example illustrates the partioning at cracking temperature of vanadium contained in a gas oil feed between a commercial cracking catalyst and particles of carbonaceous material which is introduced with the feed.

The feed and reaction conditions are the same as were used in Example 1, except that the initial 5 g catalyst bed contained no added carbonaceous material. Instead, this material was introduced into the system along with the gas oil feed. The carbonaceous material used was sponge coke sized to 200/400 mesh and mixed into the gas oil feed at a loading of 25 wt %.

In spite of the similar initial size range of the sponge coke particles and the FCC cracking catalyst, it was possible to recover and separate a portion of the catalyst/carbon mixture after the reaction which was larger in particle size that the initial particles. These larger particles had the appearance of carbon-enriched agglomerates, indicative of the presence of sponge coke particles much more so than in the other fraction of catalyst mixture. A carbon analysis of these two fractions confirmed that the larger particles were indeed enriched in carbon compared to the other fraction (Table II). In essence, a crude separation of sponge coke from the cracking catalyst particles was accomplished in this fashion. Moreover, the results of vanadium analyses of these two fractions clearly show that the fraction richer in carbon consistently contained more V (vanadium), indicating preferential partioning of vanadium into the sponge coke particles. In addition, the vanadium analyses shown that the smaller particle fraction has virtually the same V level as the initial FCC catalyst, indicating that the majority of particles in this fraction are just FCC catalyst particles and that they have no V scavenging ability in the presence of the added sponge coke particles. The results of these experiments are summarized in Table II.

TABLE II

| Run | Duration Time, min. | Initial Vanadium Levels: FCC Catalyst - 1150 ppm Sponge Coke - 195 ppm Particles* | V, ppm | C, wt % |
|---|---|---|---|---|
| 1 | 5 | A | 1080 | 1.38 |
| | | B | 5100 | 3.40 |
| 2 | 9 | A | 1110 | 3.36 |
| | | B | 4400 | 5.07 |

*A = small particle size fraction - predominantly coked FCC catalyst particles. B = large particle size fraction - FCC catalyst particles enriched in carbon by agglomerated sponge coke particles.

EXAMPLE 3

The ability of carbonaceous material to reduce $NO_x$ was tested under FCC regeneration temperature conditions using a bench scale, fluidized bed unit. 400 cc/min of a gas mixture containing 170 ppm No (balance $N_2$) was used as the fluidizing gas and passed through a 10 g bed of coked commercial FCC catalyst containing 0.73 wt % carbon. NO was used to represent $NO_x$, since it is known that typically greater than 95% of $NO_x$ present in an FCC regenerator is NO. To determine NO reduction, inlet and outlet NO concentrations were measured using a Beckman Model 951A chemiluminescent $NO_x$ anaylzer. For comparison, identical runs were carried out with fluidizing gas which also contained 0.75 vol % CO and 0.75 vol % $CO_2$. Baseline runs were carried out using non-carbonaceous beds consisting of both clean sand and a cleanburned FCC catalyst.

Table III shows a summary of data obtained from these experiments. Clearly, a significant NO reduction due to $NO+C-N_2+CO_2$ was accomplished over the coked FCC catalyst. This reduction occurred whether or not CO was present, indicating that the $CO+NO-N_2+CO_2$ reduction reaction was relatively unimportant under these conditions. Negligible reduction of NO occurred under any circumstance with clean sand, while clean-burned FCC catalyst shows only a slight reduction of NO in the presence of CO.

TABLE III $NO_x$ Reduction by Carbonaceous Material
Inlet Gas Mix A: 170 ppm NO, balance $N_2$
Inlet Gas Mix B: 170 ppm NO, 0.75% CO, 0.75% $CO_2$, balance $N_2$

| Bed | Temp. °C. | Outlet NO Conc. (ppm) A | Outlet NO Conc. (ppm) B | % NO Reduction A | % NO Reduction B |
|---|---|---|---|---|---|
| Coked FCC Catalyst | 650 | 118 | 118 | 30 | 30 |
| | 700 | 84 | 84 | 51 | 51 |
| "Clean" FCC Catalyst | 650 | 168 | 151 | 1 | 11 |
| | 700 | 173 | 152 | 0 | 11 |
| Sand | 650 | 166 | 168 | 2 | 1 |

TABLE III-continued $NO_x$ Reduction by Carbonaceous Material
Inlet Gas Mix A: 170 ppm NO, balance $N_2$
Inlet Gas Mix B: 170 ppm NO, 0.75% CO, 0.75% $CO_2$, balance $N_2$

| Bed | Temp. °C. | Outlet NO Conc. (ppm) A | Outlet NO Conc. (ppm) B | % NO Reduction A | % NO Reduction B |
|---|---|---|---|---|---|
| | 700 | 164 | 163 | 4 | 4 |

What is claimed is:

1. In a fluid catalytic cracking process for nonhydrogenative cracking of hydrocarbons, which cracking process comprises cofeeding active hot solid zeolite cracking catalyst and crackable hydrocarbon feed to a cracking zone; cracking said feed to hydrocarbon products while depositing coke, nickel and vanadium on said catalyst; disengaging said coked catalyst from said hydrocarbon products; passing said coked catalyst to a regeneration zone; passing an oxygen containing gas upwardly through said regeneration zone and at sufficient velocity to fluidize said catalyst contained therein; retaining said catalyst in said regeneration zone at a temperature and for a time sufficient to burn coke off said catalyst thereby heating and reactivating it and producing a flue gas comprising carbon oxides; returning said reactivated, heated catalyst to said cracking zone; concomitantly removing an amount of a circulating inventory of said catalyst from said process and replacing it with fresh makeup catalyst; the improvement which comprises:

adding to said circulating inventory of zeolite cracking catalyst separate particles of sponge coke having a selectivity for vanadium, $K_v$, of at least about 10, said addition being effective to provide about 0.1 to about 10.0 weight percent of said sponge coke particles in said cracking zone.

2. The cracking process described in claim 1 wherein said solid carbonaceous particles are added in admixture with said fresh makeup catalyst or with said hydrocarbon feed.

3. In a fluid catalytic cracking process for nonhydrogenative cracking of hydrocarbons, which cracking process comprises cofeeding active hot solid zeolite cracking catalyst that contains a Pt group metal CO-oxidation promoter and crackable hydrocarbon feed to a cracking zone; cracking said feed to hydrocarbon products while depositing coke, nickel and vanadium on said catalyst; disengaging said coked catalyst from said hydrocarbon products; passing said coked catalyst to a regeneration zone; passing an oxygen containing gas upwardly through said regeneration zone and at sufficient velocity to fluidize said catalyst contained therein; retaining said catalyst in said regeneration zone at a temperature and for a time sufficient to burn coke off said catalyst thereby heating and reactivating it and producing a flue gas comprising carbon oxides; returning said reactivated, heated catalyst to said cracking zone; concomitantly removing an amount of a circulating inventory of said catalyst from said process and replacing it with fresh makeup catalyst; the improvement which comprises:

adding to said circulating inventory of zeolite cracking catalyst separate particles of sponge coke having a selectivity for vanadium, $K_v$, of at least about 10, said addition being effective to provide about 0.1 to about 10.0 weight percent of said sponge coke particles in said cracking zone.

4. The cracking process described in claim 3 wherein less than about 2 volume percent of excess oxygen is present in the flue gas from said regeneration zone.

5. In a fluid catalytic cracking process for nonhydrogenative cracking of hydrocarbons, which cracking process comprises cofeeding active hot solid zeolite cracking catalyst and crackable hydrocarbon feed to a cracking zone; cracking said feed to hydrocarbon products while depositing coke, nickel and vanadium on said catalyst; disengaging said coked catalyst from said hydrocarbon products; passing said coked catalyst to a riser regenerator having more than one sequential regeneration zones; passing an oxygen containing gas upwardly through said regeneration zones and at sufficient velocity to fluidize said catalyst contained therein; retaining said catalyst in said regeneration zones at a temperature and for a time sufficient to burn coke off said catalyst thereby heating and reactivating it and producing a flue gas comprising carbon oxides; returning said reactivated, heated catalyst to said cracking zone; and concomitantly removing an amount of a circulating inventory of said catalyst from said process and replacing it with fresh makeup catalyst; the improvement which comprises:

adding to said circulating inventory of zeolite cracking catalyst separate particles of sponge coke having a selectivity for vanadium, $K_v$, of at least about 10, said addition being effective to provide about 0.1 to about 10.0 weight percent of said sponge coke particles in said cracking zone, and operating the last regeneration zone in the full CO-combustion mode whereby producing a flue gas having a $CO_2/CO$ ratio greater than 10.

6. The process described in claim 5 including the step of recovering metals values from said flue gas.

7. The process described in claim 5 wherein said cracking catalyst contains a Pt group metal CO-oxidation promoter.

* * * * *